United States Patent [19]

Fonti

[11] 4,049,271

[45] Sept. 20, 1977

[54] TARGET BOARD SAIL GAME

[76] Inventor: Richard A. Fonti, 11 Beckford St., Beverly, Mass. 01915

[21] Appl. No.: 712,756

[22] Filed: Aug. 9, 1976

[51] Int. Cl.[2] ..... A63B 65/10; A63B 67/06

[52] U.S. Cl. ..... 273/95 R; 273/106 B

[58] Field of Search ..... 46/DIG. 1; 273/58 R, 273/58 A, 58 B, 58 K, 95 R, 101, 102 R, 102 B, 106 R, 106 B

[56] References Cited

U.S. PATENT DOCUMENTS

| | | | |
|---|---|---|---|
| 3,176,989 | 4/1965 | Harrison et al. | 273/102 R X |
| 3,573,869 | 4/1971 | Duckett | 273/95 R X |
| 3,917,271 | 11/1975 | Lemelson et al. | 273/106 R |
| 3,941,383 | 3/1976 | Clarke | 273/95 R |

OTHER PUBLICATIONS

Black Belt; Aug., 1974; p. 66.

*Primary Examiner*—Richard C. Pinkham
*Assistant Examiner*—Vance Y. Hum
*Attorney, Agent, or Firm*—E. Thorpe Barrett

[57] ABSTRACT

A game in which a disc with an angularly extending rim covered with a multiplicity of small hooks in a fabric hook tape is adapted to be sailed to a target board having a fibrous surface to which the rim of the disc will removably adhere.

3 Claims, 7 Drawing Figures

FIG. 1
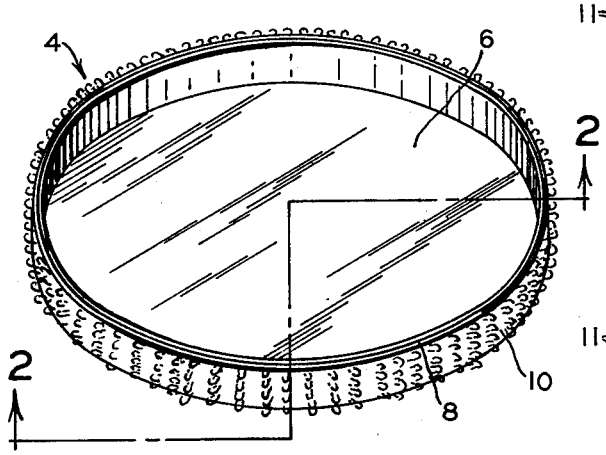
FIG. 2
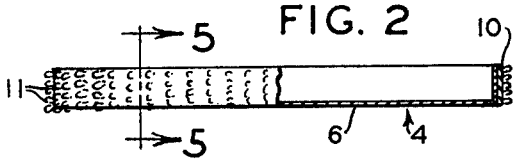
FIG. 3
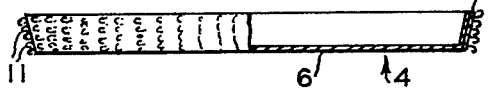
FIG. 4
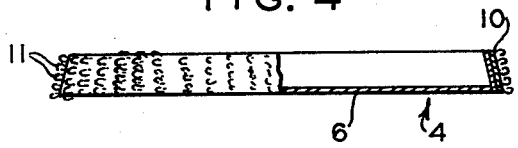
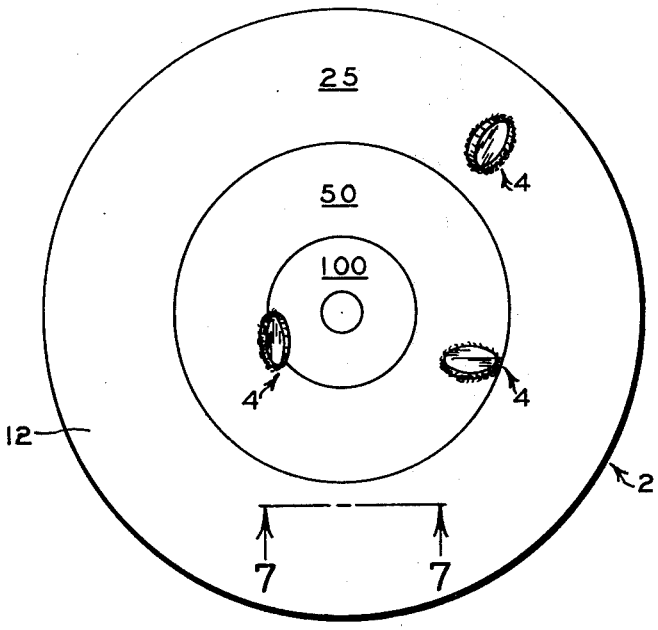
FIG. 6
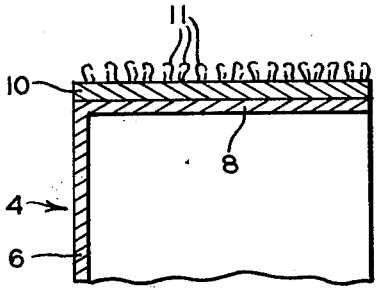
FIG. 5
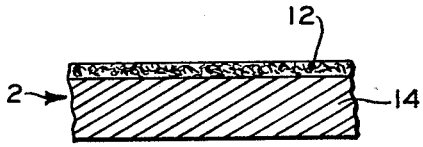
FIG. 7

TARGET BOARD SAIL GAME

This invention relates to a game adapted to be played either indoors or outdoors and in which sailing discs are thrown toward a stationary target board and upon striking the board adhere to its surface. The adhesion is provided by a multiplicity of tiny stiff hooks on the outer surface of a rim extending around the circumference of the disc.

It is an object of this invention to provide an economical, safe and enjoyable game suitable for use by individuals in widely different age groups and with widely differing inherent abilities.

It is a more specific object to provide a game in which an asymmetrical sailing missile is thrown by a spinning motion toward a target board and in which the missile is adapted to removably adhere to the surface of the target board.

These and other objects will be apparent from the following description of a preferred embodiment of the invention, considered in conjunction with the following drawings, in which:

FIG. 1 is a perspective view of the sailing game missile;

FIG. 2 is a sectional view along line 2—2 of FIG. 1;

FIG. 3 is a similar sectional view of a modified form of the missile in which the plane of the rim forms an obtuse angle with respect to the plane of the central disc;

FIG. 4 is a similar view of another form of the missile in which the plane of the rim forms an acute angle with respect to the plane of the central disc;

FIG. 5 is an enlarged view of a portion of the rim taken along line 5—5 of FIG. 2 showing the hook structure of the fabric surface of the missile rim;

FIG. 6 is an elevational view of the game board showing three of the sailing missiles in position on the board; and FIG. 7 is a partial sectional view of the target board taken along line 7—7 of FIG. 6.

Games can be divided into three categories: those in which the result is primarily a function of the respective mental or physical skills of the players (chess, checkers, horseshoes, darts, etc.); those in which the result is primarily a matter of chance (matching pennies, cutting for high card, etc.); and those which combine the elements of skill and chance (bridge, draw poker, backgammon, etc.). The first category has attractiveness only where the competing players have nearly equal skills. The second category appeals only to a small population segment of limited skills, imagination or ability. The third category, where results depend upon a combination of luck and skill (both physical and mental) includes the most popular and commercially successful games. However, the parameters for successful game design in this classification are both multiple and subtle and only a small percentage of the games developed ever become widely adopted. This invention provides a game of ability and chance in which the parameters have been tailored successfully for long-term appeal to widely varied classes of people. Physical skill and corrdination are major elements for success at the game, yet the element of chance is present to the extent necessary to permit enjoyable competition among players having substantially different levels of skills.

The game consists of a target board 2 and a number of sailing missiles 4. The missiles 4 are thrown with a spinning motion toward the board and, upon striking the surface of the board, adhere to its fibrous surface. The position of each disc on the board determines its score as in other games of this general kind.

Each missile 4, as shown in FIG. 1, consists of a circular disc portion 6 having a peripheral rim 8 extending perpendicularly from the edge of the disc so that the shape of the missile is similar to a pie pan with a vertical rim.

The outer surface of the rim 8 is covered with fabric hook tape 10 cemented to the rim 8. Fabric hook tape is widely used for cloth zippers and other applications. Generally such tape fasteners consist of two mating strips of tape: a hook tape and a loop tape. The hook tape is a woven narrow fabric tape with selvages and having small raised loops of monofilament material which are heat set to retain their shape and then cut to form a surface covered with tiny stiff hooks 11 as illustrated in FIG. 5. The mating surface is a similar tape interwoven with a dense multiplicity of yarns to form a pile or loop surface. This surface is then napped to form a continuous disoriented mass of uncut loops designed to engage with the fabric hook tape. Such tapes are manufactured by Velcro Corporation, 406 Brown Ave. Manchester, N. H. 03103 and are described in U.S. Pat. No. 3,009,235.

If one were to cover the surface of the board 2 with the loop tape, then the hook tape of the missile 4 would adhere to the board, but could be removed by pulling it off without damage to either surface. However, with smaller size missiles, loop tape is unnecessary as I have found that the use of any open weave fabric or other material having a fibrous open structure is perfectly adequate. In particular, plastic materials with a fibrous structure sufficiently open to permit the hooks to attach to it are quite satisfactory. Hence the covering 12, which is cemented or otherwise secured to the rigid supporting board 14, of wood, plastic or other material, is formed of soft, open, fibrous material with which the hooks can readily engage. This material may be made by compacting wool, fur, hair, or plastic fibers in the manner of making felt. Many suitable materials are readily available on the market and selection is merely a matter of testing to make certain the particular hook tape being used will adhere to the surface.

The sailing missiles 4 will generally be 3 to 6 inches in diameter depending upon the size of the target board 2 and whether the game is intended to be played indoors or outdoors. The height of the rim is preferably between $\frac{3}{8}$ and $\frac{5}{8}$ inches to provide suitable sailing qualities and enough surface to support the missile on the target board. The missiles are stamped or molded from metal or plastic and are as light as possible consistent with sufficient strength and rigidity to hold their shape.

In the embodiment illustrated in FIGS. 1 and 2, the rim extends perpendicularly from the plane of the disc 6. In the embodiment of FIG. 3, the rim is sloped outwardly, for example, at an angle of 100 or 110 degrees from the plane of the disc 6. In the embodiment of FIG. 4 the rim slopes inwardly forming, for example, an angle of 75° or 80° from the plane of the disc 6. In each embodiment, however, it will be noticed that the rim 8 is positioned asymmetrically with respect to the plane of the disc 6, by which is meant that the rim 8 is not centered on the plane of the disc 6 and thus produces an unbalanced structure. This construction causes the missile to sail in a more curved trajectory than if the structure were symmetrical about the plane of the disc 6. This asymmetrical structure introduces both an element of luck and a requirement for higher skills than would be the case for a symmetrical structure such as is used in the game of darts.

From the foregoing it will be seen that the described embodiment of my invention is well adapted to meet the ends and objects herein set forth, to be economically manufactured, and to to be readily adaptable to the particular requirements of each application.

I claim:

1. In a game comprising a planar target board having a fibrous surface with appropriate scoring designations thereon, a missile adapted for sailing toward and adherence to said board including a circular disc portion, a circular peripheral rim formed integrally with and extending at an angle from and completely around the circumferance of said disc portion, said rim being positioned asymmetrically with respect to the plane of said disc portion, and a strip of fabric hook tape secured to and extending around the outer surface of said rim.

2. A missile as claimed in claim 1 wherein said rims forms an inner acute angle with respect to the plane of said disc portion.

3. A missile as claimed in claim 1 wherein said rim forms an inner obtuse angle with respect to the plane of said disc.

* * * * *